United States Patent [19]

Dornier et al.

[11] 4,365,650

[45] Dec. 28, 1982

[54] WEAVING MACHINE WITH A PROTECTIVE COVERING

[75] Inventors: Peter Dornier, Lindau; Florian Windischbauer, Haslach, both of Fed. Rep. of Germany

[73] Assignee: Lindauer Dornier Gesellschaft mbH., Fed. Rep. of Germany

[21] Appl. No.: 188,290

[22] Filed: Sep. 18, 1980

[30] Foreign Application Priority Data

Oct. 9, 1979 [DE] Fed. Rep. of Germany ..... 2940824

[51] Int. Cl.[3] ..... D03D 49/00; D03J 1/00

[52] U.S. Cl. ..... 139/1 R; 139/1 C; 98/115 R; 98/115 VM; 57/308

[58] Field of Search ..... 139/1 C, 1 R; 98/115 R, 98/115 VM; 66/168; 57/304, 308; 118/DIG. 7; 15/301

[56] References Cited

U.S. PATENT DOCUMENTS

| | | | |
|---|---|---|---|
| 3,073,106 | 1/1963 | Tsuzuki | 57/308 |
| 3,378,998 | 4/1968 | Shackelford | 139/1 C |
| 4,227,552 | 10/1980 | Baumann | 139/1 C |

FOREIGN PATENT DOCUMENTS

| | | | |
|---|---|---|---|
| 2334432 | 11/1975 | France | 98/115 VM |
| 2027876 | 2/1980 | United Kingdom | 139/1 C |
| 2027878 | 2/1980 | United Kingdom | 139/1 C |

*Primary Examiner*—James Kee Chi

*Attorney, Agent, or Firm*—James E. Bryan

[57] ABSTRACT

This invention relates to an improvement in a weaving machine with fixed screening surfaces mounted below the plane of weaving and with a movable covering above the plane of weaving and separated from said screening surfaces by a warp-side and cloth-side gap, and with a climate-control system for the space enclosed by the screening and covering surfaces, the improvement comprising that the movable covering is a rigid hood means open toward the weaving plane and pivotal either (a) into a rear position, whereby the cloth-side part of the weaving machine with shed and reed and a passage to the warp-side are made accessible in order to remedy ruptures of filling and warp yarns, or (b) into a front position, whereby the warp-side part of the weaving machine and the heddles are made accessible for changing heddles.

19 Claims, 12 Drawing Figures

WEAVING MACHINE WITH A PROTECTIVE COVERING

This invention relates to a weaving machine with fixed screening surfaces mounted below the plane of weaving and with a movable covering mounted above the weaving plane and separated from the screening surfaces by a warp-side and a cloth side gap, and with a climate control means for the space enclosed by the screening and covering surfaces. The term climate control means also includes apparatus for ventilating or evacuating dust and dirt particles.

Weaving machines must meet the requirement of protective steps on one hand to prevent accidents by unintentional penetration, for instance into the path of the reed during the beat-up motion, and on the other hand also to dampen as much as possible the enormous noise generated in operation. A further requirement is that the machinery should be climate-controlled in order to maintain predetermined temperature ranges or a given air humidity and the like, or to remove dust and dirt particles by ventilation.

In equipment known from U.S. Pat. No. 3,627,201, a movable cabin provided with air conditioning connections on the floor is placed over the entire weaving machine, being made accessible in case of yarn rupture by hoisting the cabin. Such a design requires unnecessarily large and expensive covering surfaces as regards the purpose proper, and, furthermore, substantial forces must be applied to lift the cabin, whereby uneconomical costs are incurred.

Partial coverings for weaving machinery also are known, for instance from U.S. Pat. No. 4,074,725. These partial coverings apply only to the reed region and extend only from the heddles to the side of the ware. They consist of unfolding rigid parts or of elastic, foil-shaped material. While accident prevention is thus achieved, only a most restricted noise dampening on the other hand will be possible. Climate control is inadequate.

British Pat. No. 1,553,660, describes a weaving machine relating only to one covering means above the weaving plane essentially from the warp-side to the cloth side deflection beams. The covering consists of a front and a rear part, both being mounted to a support extending above the machine so that they can be flipped up. This support in case of yarn rupture together with its opened flaps can be moved forwardly to provide access from the rear to the heddles to change them. This solution has the drawback that when repairing a warp thread rupture and the operator being required to retrieve the yarn from the shed and to reach over the frames, a certain minimum spacing from the upper edge of the shaft frame to the support is required. Because of this minimum spacing the covering plates are larger than necessary. Further the above stated application has the drawback that, due to the covering being above the plane of weaving only, there is the basic drawback that sound waves will propagate downwardly and be reflected from the floor into the weaving room.

In order to implement also a covering at the lower part of the fabric, British Pat. Application No. 2,008,160, discloses a design in which freely hanging cover curtains are used for the warp beam and the fabric beam. However, this design does not adequately protect against noise and furthermore can be used for good climate control or ventilation only conditionally.

U.S. Pat. No. 3,391,528, discloses a weaving machine enclosed for the most part by a noise-damping encapsulation. This encapsulation contains a stationary part surrounding especially that part of the machine located below the plane of weaving and furthermore two sideways closure means projecting beyond the plane of weaving and supporting an upper horizontal stationary cover wall above the heddles. One movable cover plate is mounted to this wall both warp-side and cloth side and is capable of pivoting upward. A gap for passing the warp yarns and the finished fabric through is present in each case between the fixed lower part and the upward pivotal plates. This design, on account of the almost complete encapsulation, provides adequate protection against accidents and noise, and furthermore also offers climate control. However, the upper cover wall is in the way because it covers the heddles so that these are accessible only with difficulty. Furthermore, that part of the protective covering located above the weaving plane has a large area.

Based on a weaving machine of the last cited kind, it is the object of the invention to create a protective covering of minimal total area and allowing simple handling which offers encapsulation with effective noise protection and furthermore good accessibility to the work sites on the weaving plane. Also, simple and useful ventilation is possible. This problem is solved by the invention by designing the movable covering as an open rigid hood open toward the plane of weaving and in that depending upon need, the movable covering (a) is pivotal into a rear position, where the cloth-side part of the weaving machine with the shed and reed and a passage to the warp-side for remedying ruptures in warp and fillings are made accessible, or (b) is pivotal into a front position, where the warp-side part of the weaving machine and the heddles are made accessible, in order to change the latter.

The lower opening of the hood is essentially bounded by the walls of the machine, the expander shaft and the warp thread stop. In case of a malfunction signal, for instance a yarn rupture, the covering hood is automatically opened in such a manner by an appropriate mechanism that good accessibility will be provided in the entire front and rear region of the plane of weaving. As the hood is moved as a entity from the covering position, the hood contour may pass closely above the heddles, so that minimal covering areas and hence also low costs will result. The hood is an integral structure reinforced at its upper part by air conditioning ducts mounted thereto.

The automatic opening process of the hood is implemented for instance by coupling unlocking elements with filling and warp stops, the hood being lifted by the elastic force from compressed gas or the like. This automatic opening of the hood offers the significant advantage in weaving operation that no loss of time takes place when there is yarn rupture and that the work site is once accessible. Furthermore, the lifted hood is an unmistakable sign to the operating personnel.

When changing heddles, if the pack of heddles is introduced from the warp-beam side into the weaving machine, the covering hood following the disconnection of its junctions to the bearings, for instance removing a bolt, can be moved forward by being rotated about an axis of rotation that coincides essentially with its front lower edge. The invention therefore represents a substantial improvement over the encapsulation known from U.S. Pat. No. 3,391,528.

Together with the stationary screen below the plane of weaving, the movable covering hood constitutes an encapsulated space. The fixed screen essentially is composed of a damping structure connecting the walls of the weaving machine and open toward the plane of weaving and surrounding the shaft space, whereby the warp and cloth beams are located outside the encapsulation. However the stationary lower screen means is no part of the invention. By the cooperation of the stationary and movable covering parts to form an encapsulation, good climate control or ventilation of the weaving machine can be achieved.

In order to render the movable covering hood adjustable to the shed geometry if so required when selecting another position of the whip roll and/or the warp stop, and thus to ensure minimal gaps between the capsule structure and the fabrics, the rear wall of the movable hood or of the fixed lower screen may be subdivided in elevation and include pivotal or otherwise adjustable fitting parts.

An illustrative embodiment of the invention is descrived below in relation to the drawings, in which.

Figure 9A:
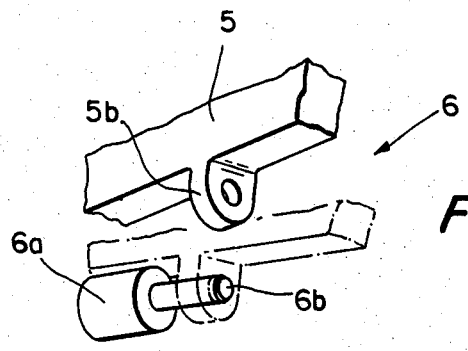
Figure 9B:
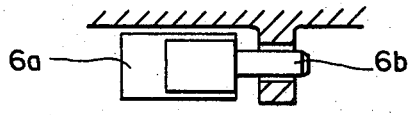
Figure 9C:
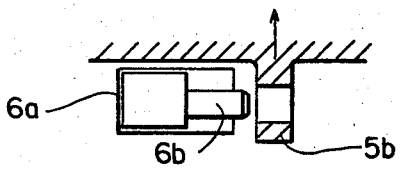

FIGS. 9*a* through 9*c* show details of a locking system, and

Figure 3:
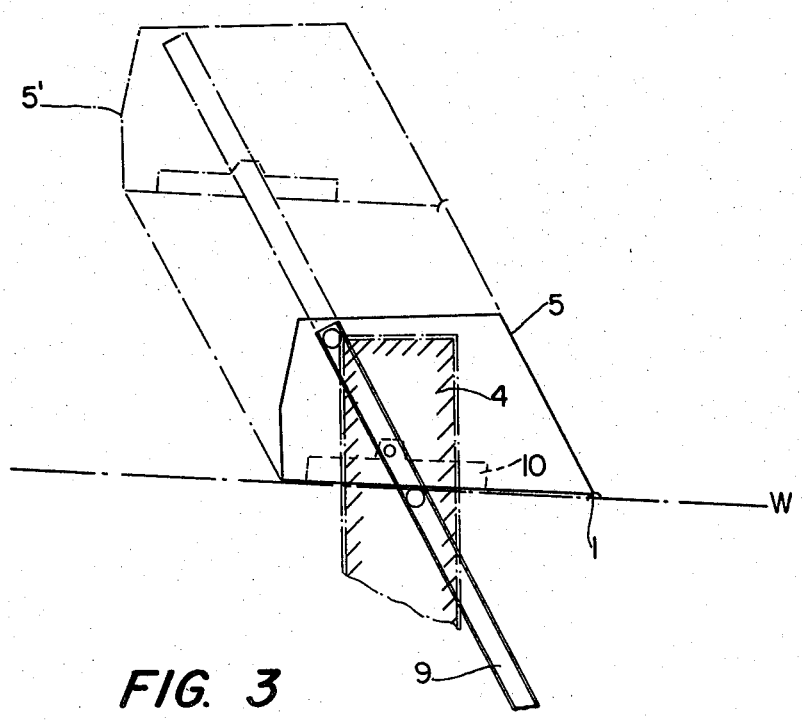
FIG. 3 is a further variation for the adjustment of the covering hood.
Figure 10:
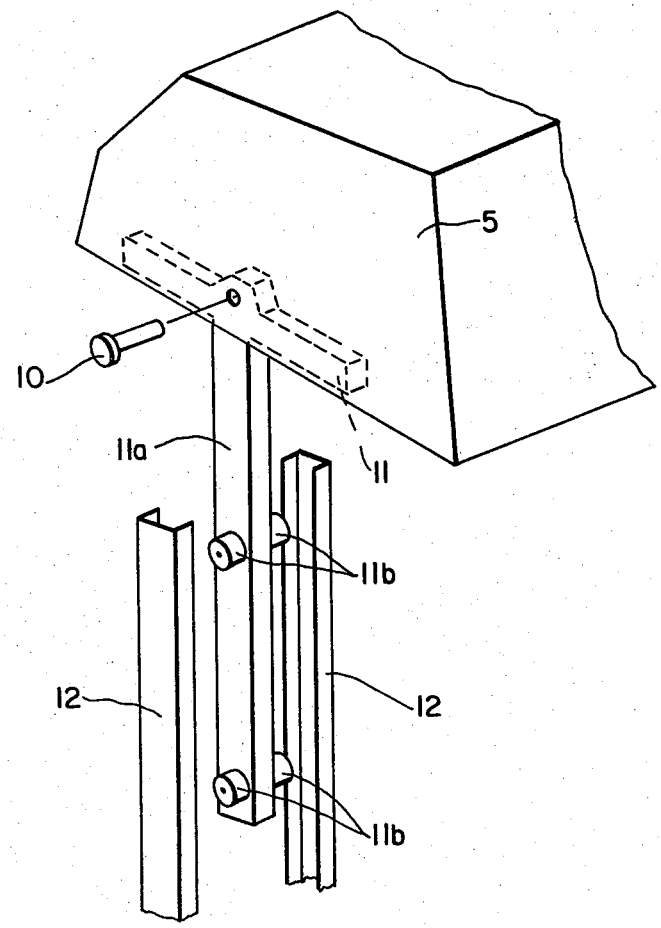

FIG. 10 shows part of FIG. 3 in perspective.

Figure 1:
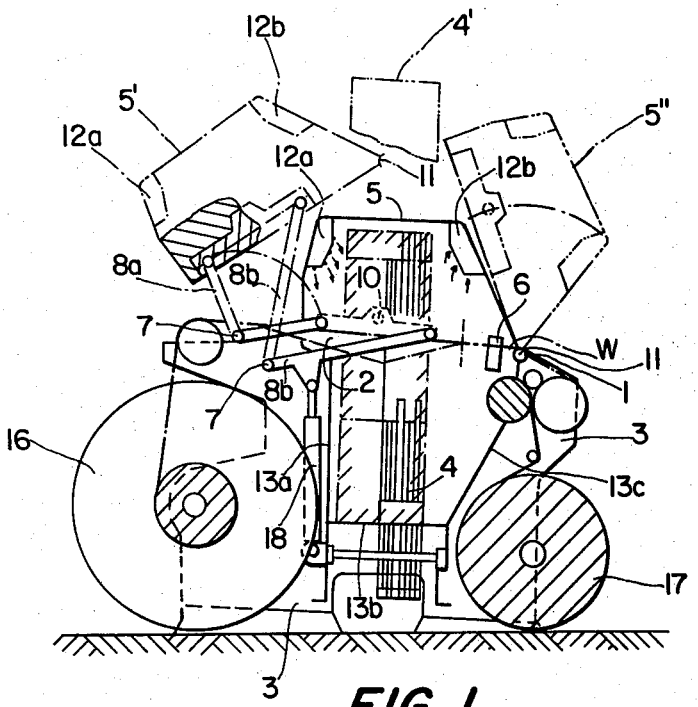
FIG. 1 is a cross-section of a weaving machine.

FIG. 1 schematically shows the design of a weaving machine seen from the side. The machine frame is denoted by 3, the warp beam by 16 and the cloth beam by 17. The heddles 4 are also indicated. The dot-dash line W shows the weaving plane. Fixed screening walls 13*a*, 13*b*, and 13*c* are mounted between the warp beam 16, the ware beam 17 and the side walls of the machine frame 3. The screening walls rise as high as the plane of weaving W. These fixed screening walls together with the frame walls act as screening means against noise and also as encapsulating means regarding the climate control for the lower part of the weaving machine. A covering hood 5 is provided above the plane of weaving W and above the pack of heddles 4, and forms gaps together with the aforesaid fixed screening walls 13*a* and 13*c* to allow passage on the warp side and cloth side to the warp yarns and the finished fabric respectively. The lower edge of the covering hood 5 essentially is bounded by the machine walls, the expander shaft and the warp stops. The surface of the hood 5 is small, whereby on one hand the hood is lightweight, and on the other hand, the space to be climate-controlled remains as small as possible, so that energy may be saved in operation.

A dot-dashed outline of the hood 5 indicates that it can be pivoted into the rear position 5'. Correspondingly, the double-dot dashed line indicates that the hood if required also can be pivoted into the front position 5''. This forward pivoting takes place about a pivot bearing 1, for instance at the lower rim of the hood. This pivot bearing is not fixed, rather it may be of detachable design. In operation, the hood 5 is locked into place, as shown by the solid lines, by means of the locking elements 6. When there is a malfunction, for instance upon detection of rupture of a warp or filling, the locking element is automatically unlocked in a manner not shown in further detail and the hood 5 is pivoted into its rear position 5'. In the illustrative embodiment shown here, this pivoting motion takes place by means of two pivot means 8*a* and 8*b* which on one hand are supported fixed to the machine at the bearing site 7 to the rear of and outside the hood 5 and which on the other hand are joined in an articulated manner to the hood 5 proper. The junction to the hood 5, for instance, can be implemented by a special connecting part 10. A pivoting drive 18 is provided for the pivoting motion; in the illustrative embodiment shown it acts on the pivot means 8*b*. The drive itself can be designed in arbitrary manner, for instance as indicated in FIG. 1 by a hydraulic or pneumatic system 18 with a piston and cylinder, or else by mechanical spring force or an electric motor with a shaft or the like. By so pivoting the hood 5 into its rear position 5', all of the plane of weaving W is easily accessible from the cloth beam and the warp-beam sides. The shed and the reed are freely exposed and in case of warp rupture, there is the required good accessibility behind the heddles. In this manner a rupture of the warp or filling yarns can be remedied without difficulties.

However, changing heddles is not possible in the above-described position 5' of the covering hood, as can be seen from the dash-dot position 4' of the pack of heddles. On the other hand it is immediately feasible to carry out a change of heddles when the hood has been pivoted into its front position 5''. To that end, the junction of the hood 5 to the rear pivot bearing 7 of the two pivoting means 8*a* and 8*b* or also the junction of the pivoting means to the hood 5 or at the connection means 10 is loosened. Also, the junction means 10 itself can be uncoupled. After unlocking the locking element 6, the hood 5 can be pivoted about the front pivot bearing 1 forward into the position 5''. As is clearly shown in FIG. 1, changing heddles is now possible because the hood when in its position 5'' no longer interferes with the lifted pack of heddles 4'.

The intrinsically rigid covering hood 5 is reinforced by two ducts 12*a* and 12*b* located at the upper longitudinal edges of the hood as indicated in FIG. 1. The two ducts 12*a* and 12*b* are used for climate control or ventilation of the encapsulated part of the weaving machine. To the sides of the ducts 12*a* and 12*b*, hook-ups for air supply and evacuation respectively are provided. As shown by the small arrows, the duct 12*a* is used for supplying air and duct 12*b* for evacuating it. Advantageously, the discharge apertures of duct 12*a* are so arranged that the ventilating flow points at the plane of weaving W. This makes possible a good climate control or also a removal of dust and dirt particles. As already indicated above, this arrangement offers a substantial advantage in that the encapsulated volume for the climate control can be kept small.

Figure 2:
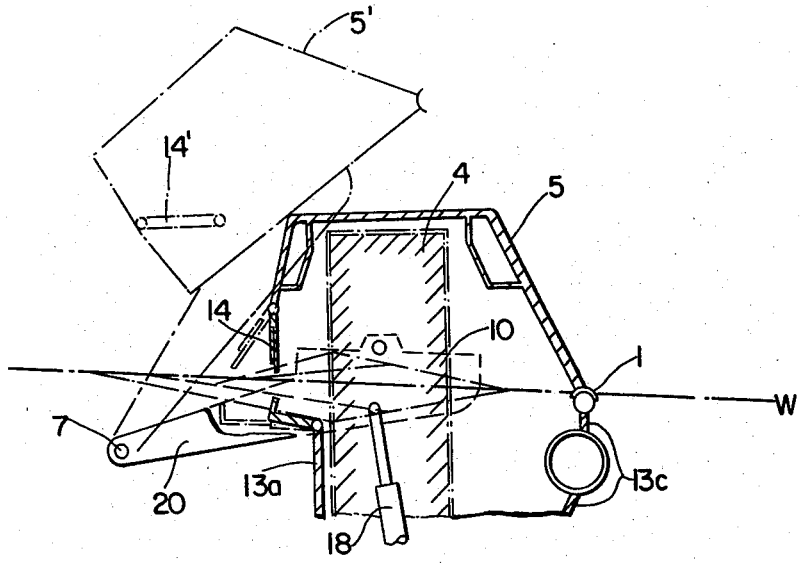
FIG. 2 is a variation for the adjustment of the covering hood.

FIG. 2 shows a variation of the arrangement of FIG. 1. In principle the arrangement of the screening walls 13*a*, 13*b*, and 13*c* below the plane of weaving W and that of the covering hood 5 are the same as in FIG. 1. The difference is merely that the hood 5 is connected by a junction means 10 to two sideways supporting arms 20. These supporting arms again can be pivoted about pivot bearings 7 mounted behind and outside the hood and which allow a simple pivoting motion of the hood 5 into the position 5'. To that end the adjustment drive 18 acts on the supporting arm 20. After loosening the junction of the supporting arm 20 to the pivot bearing 7 fixed to the machine, the hood 5 can be pivoted about the front pivot bearing 1 into the front position, not shown. Again the above mentioned drive 18 can be used.

FIG. 2 further shows that the lower part of the rear wall of the hood 5 bounding the passage gap for the warps need not be a fixed component of the rear wall, rather that where appropriate it also may be connected in an articulated manner with the rear wall. This feature is discussed in further detail below. In this instance, it is sufficient to indicate that when pivoting the hood into its rear position 5', the lower part 14 of the rear wall can be moved into a position 14' in order to achieve still better accessibility to the warps. The part 14 in this process can be pivoted in arbitrary (and omitted) manner, for instance in constrained manner by the pivot bars coupled to the pivoting mechanism of the hood 5.

FIG. 3 shows a further possible variation in schematic form. In this case the hood 5 together with its hook-up piece 10 can be displaced in a guide rail 9 obliquely upwardly into a position 5'. In this position it is again feasible to remedy, in unhampered manner, ruptures in warp and filling yarns. In order to change heddles, in this case also the junction between the hook-up piece 10 and the guide rail 9 can be loosened and then the hood 5 can be pivoted forward about the front pivot bearing 1 indicated.

Figure 4:
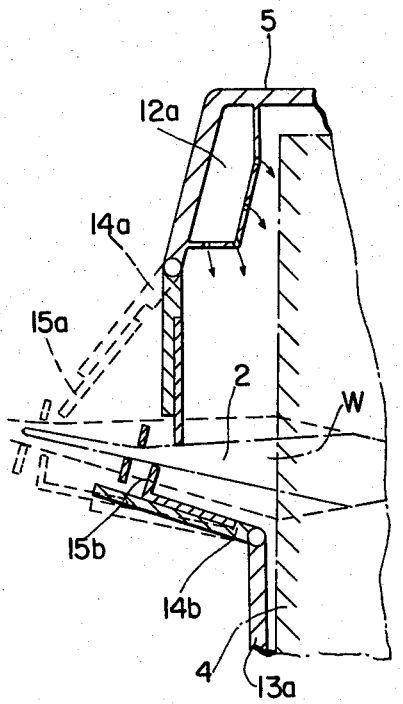
FIG. 4 is a detail from the hood back wall.

An advantageous further development of the invention is indicated in FIG. 4. The rear wall of the hood 5 and part of the fixed screening surface 13*a* are shown, the ventilation duct 12*a* with its discharge apertures being clearly recognizable in the upper edge of the hood. The rear wall itself is so subdivided below the duct 12*a* that the lower part 14*a* which bounds the passage gap for the warps is connected in articulated manner with the hood and can be pivoted for instance into the position shown in phantom. A similar subdivision also is provided in the rear wall below the weaving plane W at the fixed screening wall 13*a*. There also an end-piece 14*b* is mounted in pivotal manner to the fixed screening wall 13*a*. The two pivotal parts 14*a* and 14*b* are so designed that their lengths are adjustable using end-pieces in the form of displaceable strips 15*a* and 15*b* respectively. In this manner, for a different position of the whip roll and/or warp stop, the gap for the passage of the warp yarns always can be adjusted and always can be kept small. This possibility is indicated by the dashed lines. Where appropriate, the swinging part 14*a* can be coupled to the pivoting motion of the hood 5 by pivot bars or the like, so that the swing part does not cause damage to the warps if there is automatic pivoting of the hood 5, rather it is moved into a harmless position, as already indicated in relation to FIG. 2.

Figure 5:
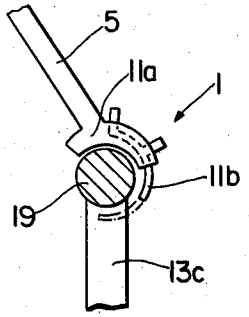
FIG. 5 is a detail from the front pivotal support.

A simple embodiment of the front pivot bearing 1 is shown in FIG. 5. The front lower edge of the hood 5 includes a claw-shaped part 11 which partly encloses a pivot shaft 19 fixed to the machine. The machine-fixed pivot shaft 19, for instance, may be supported by a front screening wall 13*c*. The claw-shaped part in the embodiment selected in this case is composed of a claw part 11*a* fixed to the hood 5 and of a claw part 11*b* which is adjustable relative thereto. The adjustability is indicated by the dot-dash lines.

In operation, the claw-shaped part 11*a* together with the adjustable part 11*b* when in the swung back position acts as a support for the hood 5. As can be seen, the hood 5 can be lifted off of the pivot shaft 19 freely and be pivoted into its rear position 5'. When the hood is pivoted into its front position 5'', the two claw-shaped parts 11*a* and 11*b* when in the forward swung position act as a locking means and together with the pivot shaft 19 as a support and pivot bearing. It is furthermore immediately possible to so lock together the claw-shaped part 11 with the pivot shaft 19 that even when the weaving machine is operating, a fixed connection exists at the front lower edge of the hood 5. In order to pivot the hood 5 into its rear position 5', this connection then is automatically self-opening. In this manner, special locking means 6 according to FIG. 1 can be eliminated.

Figure 6:
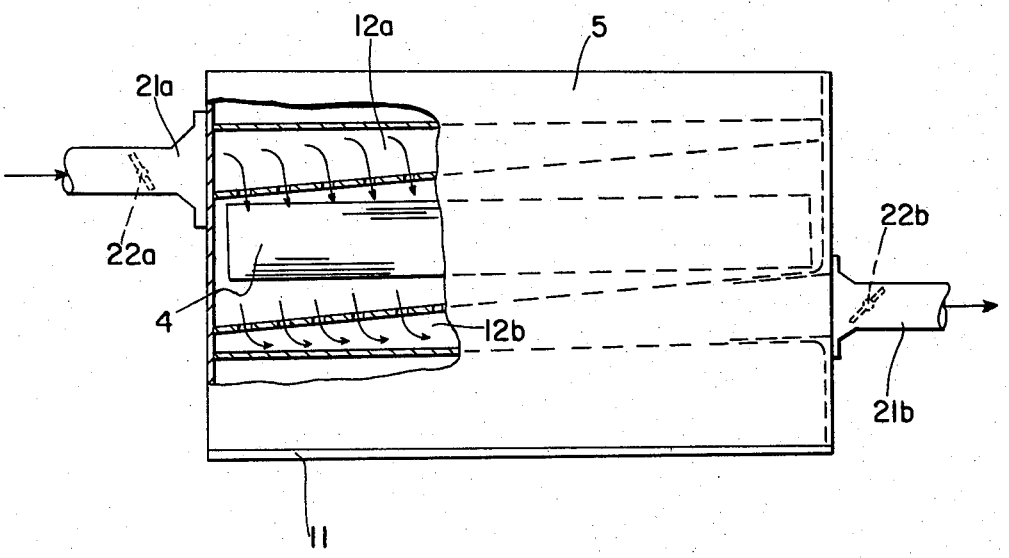
FIG. 6 is a top view of the hood.

FIG. 6 shows a top view in partial section of the covering hood 5. The ducts 12*a* and 12*b* with their passage orifices also are shown. As already mentioned, these ducts are used for climate control or ventilation and evacuation of air contaminations. They furthermore reinforce the entire hood 5. Hook-up means 21*a* and 21*b* for the supply and evacuation respectively of the climate control air are provided at the side walls of the hood 5 at the level of the ducts 12*a* and 12*b* respectively. The hook-up means 21*a* and 21*b* can be detached from the hood 5 when it is being pivoted and remain in place. Valves 22*a* and 22*b* respectively in the hook-up means are closed to effectively keep the ventilation conduits separate. Advantageously, the ventilation ducts are so designed that beginning at the hook-up means, their cross-section tapers. In this manner a uniform supply and evacuation of the air flow is made possible within the encapsulated space.

Figure 7:
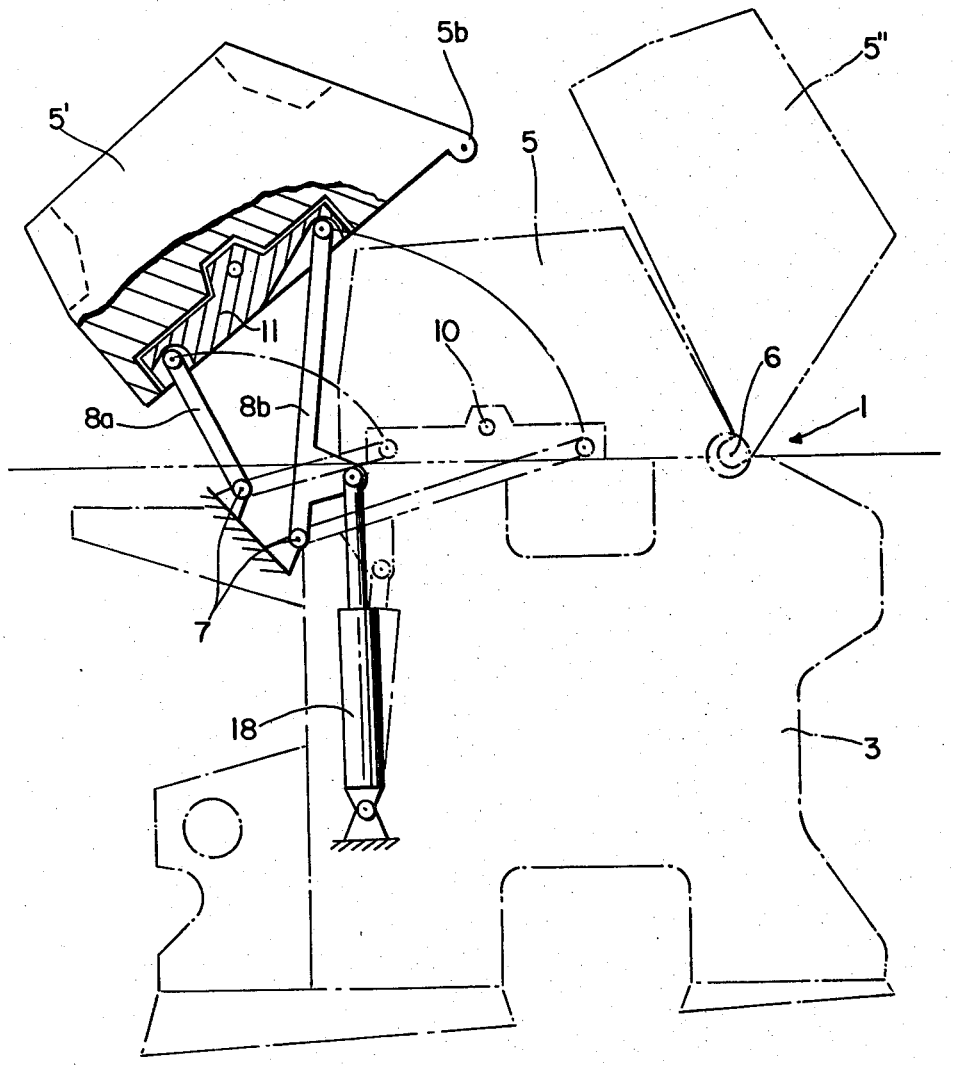
FIG. 7 shows the pivotal mechanism of FIG. 1.

FIG. 7 is similar to FIG. 1, with some details omitted and the pivoting mechanism for the hood 5 being shown more clearly. The essential parts from FIG. 1 have been transferred.

The side-wall 3 of the weaving machine is shown in dash-dot lines. All pivot or swivel bearings for the motion of the covering hood 5 are mounted to this side wall so as to be rigidly connected to the weaving machine. As in FIG. 1, the hood 5 is shown in various positions, namely it is shown in the normal position 5 in dash-dot lines, i.e., during operation, in a rear pivoted position 5' (shown in solid lines) and in a front pivoted position 5'' (in dash-dot lines). The pivoting from the normal position 5 into the position 5' is carried out by means of linkages 8*a* and 8*b* which are supported on one hand in bearings 7 at the side wall 3 and on the other hand (as in FIG. 1) in the connecting part 11 of the hood 5.

Figure 8:
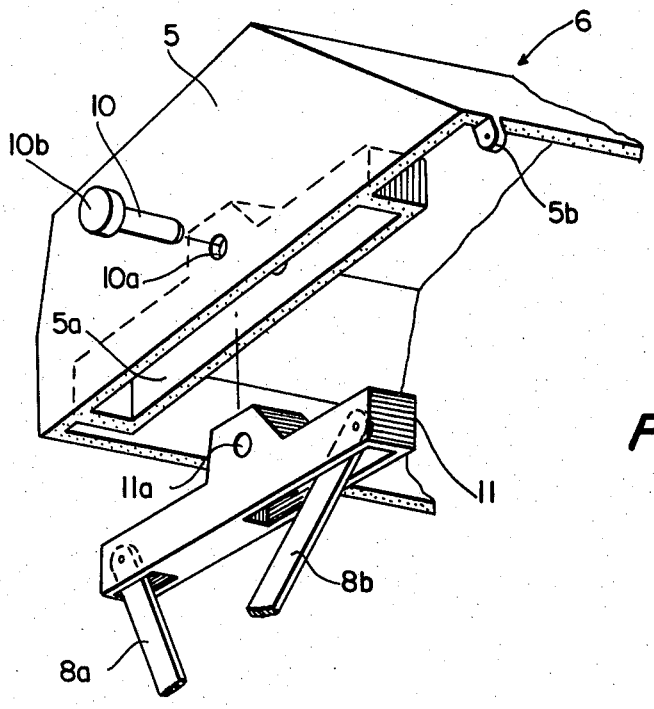
FIG. 8 shows part of FIG. 7 in perspective.

FIG. 8 shows details of the linkages and the connecting part 11 at the hood. A pneumatic or hydraulic drive means 18 is illustratively provided as the pivoting-implementing means at the linkage 8*b*, composed of pistons and cylinders. This system 18 rests on a bearing site, not described in further detail, of the side wall 3. For the rearward-pivoted position 5' of the hood, the Figure shows an ear 5*b* at the forward and lower edge of the hood, which (as shown further in FIG. 9) may be part of the front pivot bearing 1 and of the locking system 6. As mentioned above, the locking system is released when pivoting to the rear takes place.

Again, as already mentioned, the connection between the hydraulic drive 18 and the hood 5 is released, for instance at the connecting part 11, in order to pivot the hood into the front position 5''. FIG. 8 shows one instance. As regards the presently considered pivoting motion, the locking system 6 acts as a part of the front pivot bearing 1.

FIG. 1 indicates, in a simplified manner, a way of connecting, at 10, the pivot mechanism to the hood 5. FIG. 8 illustrates a special way of connecting the pivot mechanism with its linkages 8*a* and 8*b* to the hood 5. The individual parts are shown in an exploded view. A downwardly open connecting seat 5*a* for receiving a connector means or a shaped part 11 is integrated into the side wall of the hood 5. The two linkages 8*a* and 8*b* act in an articulated manner on this shaped part 11. During assembly, the shaped part 11 is introduced into the connecting seat 5*a* and there it is kept in place by a pin 10. The pin 10 is passed through the plug holes 10*a* and 11*a* in the wall of the hood 5 and in the shaped part or connecting part 11, respectively, thereby securing the pieces together. If, for instance, this connection must be released prior to a pivoting motion into the forward hood position, then the pin can be easily and simply pulled out by means of a gripping ring 10*b* or the like. Obviously, corresponding devices are mounted on the other side of the weaving machine.

A locking system 6 indicated in FIG. 1 is shown in FIGS. 9*a* through 9*c*. This system functions in the same manner as the embodiment of FIG. 5, namely on one hand as a locking means and on the other as a front pivot bearing. The design of the locking system 6 is clearly shown in the partial FIG. 9*a*. One or several ears 5*b* are located at the front edge of the hood 5, as already mentioned above in relation to FIGS. 7 and 8, which advantageously are integrated into the hood 5. As shown in FIG. 8, such an ear 5*b* is locàted illustratively at the front and side of the hood 5. Similarly to the case shown in FIG. 5, locking mechanisms 6 are mounted for instance at the solid, front screening wall 13*c* to the lower part of the weaving machine, which contain essentially an advancing or retracting locking bolt 6*b*. This bolt 6*b* when in the advanced position engages the particular ear 5*b* associated therewith and in this manner prevents the hood 5 from being lifted. Thereby, the bolt 6*b* when in this position simultaneously acts as a pivot means for the front pivot bearing 1 of the hood 5. The locked position of the hood 5 is shown in dash-dot lines in FIG. 9*a*, whereas the solid lines represent the raised hood when the locking system is released. The locking bolt 6*b* can be advanced or retracted in a variety of ways, for instance manually, hydraulically, pneumatically, and also electromagnetically, and in this manner locking may be introduced or removed.

FIG. 9 is a simplified section of the locking system 6 with an actuation and return mechanism 6*a* and the advanced bolt 6*b* engaging the ear 5*b*. The hood 5 therefore is locked and the bolt 6*b* therefore can act as a pivot for the rotation of the hood into the forward position 5″ (note FIG. 7). When in the position of FIG. 9*c*, the bolt 6*b* is retracted and the system is unlocked. Now the hood can be lifted in the direction of the arrow and be pivoted into the rearward position 5′ (note FIG. 7).

FIG. 10 shows part of FIG. 3. Again it is assumed that the connection between the displacing mechanism and the hood is implemented at both ends of the hood 5, similarly to the case for FIG. 8, by a shaped part 11 and retaining pin 10. The arrangement is shown in the disassembled state. A roller support 11*a* is fixed to the shaped part 11 and running and guiding rollers 11*b* project therefrom in opposite directions. These running rollers 11*b* are guided in two rails, enclosing the rollers, during the displacing motion of the hood 5. The displacing motion of the hood 5 in this example consists of an up-and-down motion within the guide rails 12, not shown in further detail, for instance by means of a cable or a hydraulic means.

It will be obvious to those skilled in the art that many modifications may be made within the scope of the present invention without departing from the spirit thereof, and the invention includes all such modifications.

What we claim is:

1. In a weaving machine with fixed screening surfaces mounted below the plane of weaving and with a movable covering above the plane of weaving and separated from said screening surfaces by a warp-side and cloth-side gap, and with a climate-control system for the space enclosed by the screening and covering surfaces, the improvement comprising that the movable covering is a rigid hood means open toward the weaving plane and pivotal either (a) into a rear position, whereby the cloth-side part of the weaving machine with shed and reed and a passage to the warp-side are made accessible in order to remedy ruptures of filling and warp yarns, or (b) into a front position, whereby the warp-side part of the weaving machine and the heddles are made accessible for changing heddles.

2. A weaving machine according to claim 1 in which a connection of the hood means to support sites associated with said rear position is detachable.

3. A weaving machine according to claim 1 in which the hood means includes detachable pivot bearings in the region of its front lower edge.

4. A weaving machine according to claim 3 in which the pivot bearings include claw-shaped fastening means which partially and loosely enclose a pivot shaft fixed to the machine.

5. A weaving machine according to claim 1 including means whereby the hood means can be obliquely translated upwardly and to the rear.

6. A weaving machine according to claim 1 including means whereby the hood means can be pivoted about pivot bearings, to the rear and outside of the hood means into its rear position.

7. A weaving machine according to claim 1 including means for the automatic displacement of the hood means into its rear position when a malfunction signal is given.

8. A weaving machine according to claim 6 or claim 7 including two sideways support arms for the hood means which are pivotally supported by the machine.

9. A weaving machine according to claim 6 or claim 7 including pairs of guide means forming a four-link mechanism each with their machine-fixed bearing sites and mounted sideways to the hood means, and essentially pointing rearwards.

10. A weaving machine according to claim 1 in which the rear wall of the hood means is subdivided in elevation and means whereby the lower part is adjustable in its height.

11. A weaving machine according to claim 10 including means whereby the rear wall of the hood means is subdivided in an articulated manner in its elevation.

12. A weaving machine according to claim 11 in which a wall part, which is connected in an articulated manner, is coupled by guide means with an adjustment drive to pivot the hood means into its rear position.

13. A weaving machine according to claim 1 in which the upper side of the hood is flat and includes one ventilation duct with discharge apertures inside at its upper longitudinal edges, an external hook-up of one of the ducts being located on one end face and the external hook-up of the other duct on the other end face of the hood means.

14. A weaving machine according to claim 13 in which a duct located behind the heddle shafts is designed as a ventilation duct and a duct located in front of the heddles is designed as an evacuation duct.

15. A weaving machine according to claim 13 in which sideways duct hook-ups located outside the hood means can be uncoupled and are provided with valves.

16. A weaving machine according to claims 13 or 14 in which the ducts each have a cross-section that flares towards sideways hook-up sites.

17. A weaving machine according to claim 1 including means whereby an upper closure part of a rear fixed screening surface is adjustable in position.

18. A weaving machine according to claim 17 in which the upper closure part includes displaceable edge pieces.

19. A weaving machine according to claims 17 or 18 including means mounting the upper closure part in a swing-out manner.

* * * * *